United States Patent [19]

Latassa et al.

[11] 4,282,455

[45] Aug. 4, 1981

[54] MERCURY DISPENSER FOR ARC DISCHARGE LAMPS

[75] Inventors: Frank M. Latassa, Magnolia; Roland L. Bienvenue, Lawrence; Charles H. Poirier, Topsfield; John Wallace, Salem, all of Mass.

[73] Assignee: GTE Products Corporation, Stamford, Conn.

[21] Appl. No.: 92,000

[22] Filed: Nov. 7, 1979

[51] Int. Cl.[3] ..... H01J 61/28

[52] U.S. Cl. ..... 313/177

[58] Field of Search ..... 313/177, 174, 176, 180

[56] References Cited

U.S. PATENT DOCUMENTS 4,056,750 11/1977 Latassa ..... 313/177

*Primary Examiner*—Ernest F. Karlsen

*Attorney, Agent, or Firm*—James Theodosopoulos

[57] ABSTRACT

A mount for an arc discharge lamp has a cathode thereon which is encircled by a disintegration shield. The shield has a narrow gap between its ends with a mercury-containing metal capsule in the gap. The capsule is comprised of a metal cup having a larger diameter portion and a smaller diameter portion, the larger diameter portion having been flattened and sealed after the mercury has been dispensed into the capsule. The flattened larger diameter portion of the capsule is welded across the gap of the shield.

2 Claims, 3 Drawing Figures

MERCURY DISPENSER FOR ARC DISCHARGE LAMPS

TECHNICAL FIELD

This invention is concerned with low pressure arc discharge lamps, particularly fluorescent lamps, and with the method of dispensing mercury therein.

BACKGROUND ART

Prior art methods of dispensing mercury into fluorescent lamps are disclosed in U.S. Pat. No. 4,056,750, the disclosure of which is incorporated herein by reference. Sealed capsules, both glass and metal, have been used to contain the mercury within the lamp. After the lamp has been sealed, the capsule is ruptured to release the mercury.

DISCLOSURE OF INVENTION

This invention concerns a metal capsule for dispensing mercury into an arc discharge lamp after the lamp is sealed. The capsule is more suitable for use in automatic lamp manufacturing equipment than the metal capsule disclosed in U.S. Pat. No. 4,056,750.

The capsule is made from a metal cup having a larger diameter portion and a smaller diameter portion. The larger diameter portion may be made of thinner wall material than the smaller diameter portion. The mercury is sealed in the capsule, and the capsule is attached to a disintegration shield of a fluorescent lamp mount. After the lamp is sealed, the thinner wall portion of the capsule is ruptured to release the mercury.

BEST MODE FOR CARRYING OUT THE INVENTION

Figure 1:
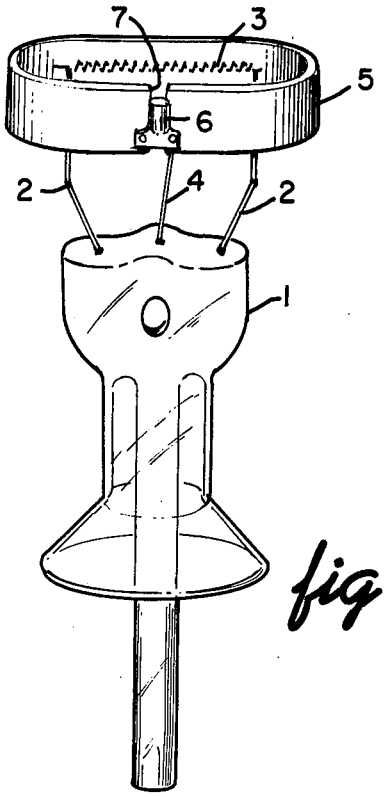
FIG. 1 is a perspective view of a discharge lamp mount embodying a mercury containing capsule in accordance with this invention.
Figure 3:
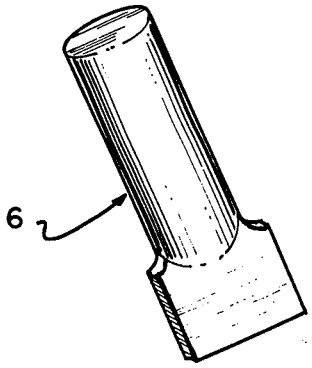
FIG. 3 shows the metal cup after it is sealed.

As shown in FIG. 1, glass mount 1 of an arc discharge lamp has lead-in wires 2 embedded therein, cathode 3 being mounted on wires 2. Surrounding cathode 3 is a metal disintegration shield 5 which is supported by wire 4 embedded in mount 1. Shield 5 completely encircles cathode 3 except for a small gap 7 between the ends of shield 5. Bridging gap 7 is a mercury containing metal capsule 6.

Figure 2:
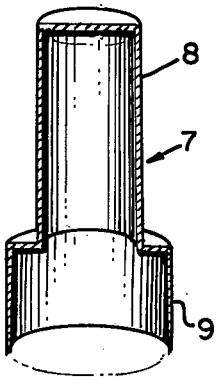
FIG. 2 is a sectional view of the metal cup from which the capsule is made.

In one example, shown in FIG. 2, metal capsule 6 was made from a stainless steel cup 7 having a smaller diameter portion 8, which was closed at its end, and a larger diameter portion 9 which was open. Portion 8 was $4\frac{1}{4}$ mm long by 70 mils diameter with a wall thickness of 1 mil.

A desired amount of mercury, say, 15 mg, was dispensed into cup 7 and portion 9, that is to say, the open end thereof, was then flattened and hermetically sealed to form capsule 6. Flattened portion 9 was then welded across gap 7 of shield 5 so that it was closer to the end of the lamp than was portion 8.

After the lamp is sealed, the mercury in capsule 6 can be released by RF induction heating of shield 5. The induced current flowing across gap 7 flows preferentially through flattened portion 9 and causes it to split or rupture, thereby releasing the mercury in the direction of the end of the lamp. Since the wall of portion 9 is thinner than that of portion 8, portion 9 is far more likely to rupture before portion 8.

An advantage of a double diameter cup over a single diameter cup is that the double diameter provides an advantageous means for orienting the cup prior to mercury filling. In addition, the larger diameter provides a greater target area for both mercury filling and welding to the shield, while the smaller diameter provides an advantageous means for faster transfer and feeding on manufacturing equipment.

We claim:

1. In an arc discharge lamp having a glass mount at one end with a cathode supported on the mount, the improvement comprising: a disintegration shield encircling the cathode except for a narrow gap between the ends of the shield; and a mercury containing metal capsule disposed in the gap and electrically connected to the ends of the shield, the metal capsule having been formed from a cup having a larger diameter portion and a smaller diameter portion, the larger diameter portion having been flattened and sealed, the larger diameter being the part of the capsule that is electrically connected to the ends of the shield so that when an RF current is induced in the shield the current flow through the capsule primarily occurs through the flattened larger diameter portion.

2. The improvement of claim 1 wherein the flattened larger diameter portion of the capsule is made of thinner wall material than the smaller diameter portion in order that it preferentially rupture first upon being RF heated.

* * * * *